United States Patent [19]

Barton et al.

[11] Patent Number: 4,511,130

[45] Date of Patent: Apr. 16, 1985

[54] PHASE CONTROLLED GRIPPER OPERATING SYSTEM FOR COLLATOR

[75] Inventors: Delmar O. Barton, Salem; Loran R. Simpson, Ames, both of Iowa

[73] Assignee: Metromail Corporation, Mount Pleasant, Iowa

[21] Appl. No.: 518,038

[22] Filed: Jul. 28, 1983

[51] Int. Cl.[3] ..... B65H 39/02

[52] U.S. Cl. ..... 270/54; 270/58; 271/85; 271/268; 53/540

[58] Field of Search ..... 270/54, 58; 271/85, 271/268; 53/540; 198/653, 696, 421, 486, 858, 577; 414/730, 224–226

[56] References Cited

U.S. PATENT DOCUMENTS

| | | | |
|---|---|---|---|
| 2,325,455 | 7/1943 | Williams | 53/57 |
| 3,891,204 | 6/1975 | Mager | 271/85 |
| 3,900,193 | 8/1975 | Theisz et al. | 271/85 |
| 3,951,400 | 4/1976 | Blessing | 271/85 |
| 4,297,066 | 10/1981 | Ramcke et al. | 271/85 |
| 4,344,729 | 8/1982 | Orsinger | 271/268 |
| 4,365,797 | 12/1982 | Fitzpatrick | 271/303 |

*Primary Examiner*—E. H. Eickholt

*Attorney, Agent, or Firm*—Harvey B. Jacobson

[57] ABSTRACT

The phase relationship of gripper jaw operation to gripper arm travel is adjustable in a collator to obtain proper sheet release during gripper arm travel. At least two trip elements actuate the jaw operating mechanism at adjusted phase locations of the gripper arm while a stop engageable with the operating mechanism limits jaw opening movement.

12 Claims, 6 Drawing Figures

PHASE CONTROLLED GRIPPER OPERATING SYSTEM FOR COLLATOR

BACKGROUND OF THE INVENTION

This invention pertains to improvements in a sheet material collator of the type utilized in automatic handling equipment is related to the subject matter of a prior U.S. application, Ser. No. 269,786, filed June 2, 1981 now abandoned and owned by the assignee of the present application.

The collating of sheet material and insertion thereof into a mailing envelope is presently performed automatically by various updated versions of a machine often referred to as a "Phillipsburg Inserter" disclosed in U.S. Pat. No. 2,325,455 to Williams. The collating function performed by this machine involves oscillation of a gripper arm at each of a plurality of stations by means of a common power shaft. A jaw assembly carried at the lower end of each gripper arm engages a sheet at one end of the gripper arm stroke to carry the sheet to a location along the gripper travel path at which the sheet is released for deposit onto a conveyor passing through each of the collating stations. A pivoted holddown element is timely displaced into contact with the sheet once deposited between guide rails of the conveyor. Various interrelated drive components are provided to effect synchronized powered movement for the oscillating power shaft, the gripper jaws, the conveyor and the holddown element at each of the collating stations. In view of the complexity of the drive arrangement and wear of parts associated therewith, operational speed is limited, frequent adjustments are required and downtime loss occurs because of frequent maintenance and part replacements.

In an effort to increase operational speed, improve operational reliability and produce a more desirable product, the collating portion of the foregoing type of automatic mail handling machine has been interfaced with a film-type envelope wrapper, as referred to in prior copending application, Ser. No. 247,109, of Keith C. Koch, filed Mar. 24, 1981 owned by the assignee of the present application. The wrapper machine is therefore driven in synchronism with the collator at speeds compatible with the collating operation making adjustment and maintenance more critical.

It is therefore a general object of the present invention to provide an improved collator which is more compatible in operation with the flexible film wrapper aforementioned.

A more specific object is to provide an improved collator wherein synchronized operation of the gripper jaws is effected without reliance on the complex drive arrangement heretofore utilized in a "Phillipsburg Inserter".

A still further object is to provide a collator with phase control means for obtaining adjusted synchronized operation of the gripper jaws.

SUMMARY OF THE INVENTION

In accordance with the present invention, the gripper jaws carried by oscillating gripper arms of a collator, are controlled by means of a toggle linkage type of operating mechanism displaceable with the gripper arms through an operational stroke of fixed amplitude. Phase adjustable actuator trips are engageable with the toggle linkage for overcenter displacement thereof between jaw closing and opening positions at predetermined phase locations of the gripper arm during travel through its operational stroke. In this manner, powered drive connections to the gripper jaws are eliminated and phase adjustment of jaw operation may be made more readily and independently of other synchronized operations.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
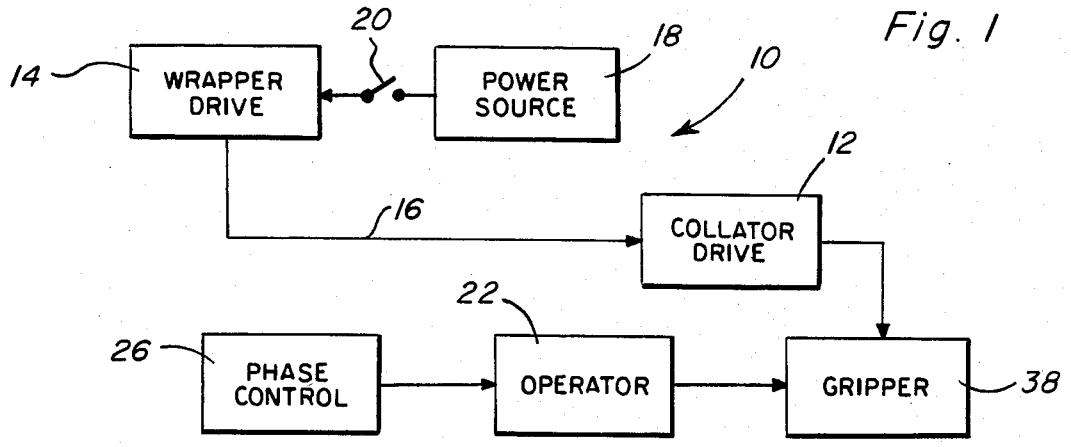
FIG. 1 is a schematic block diagram illustrating the control system associated with the present invention.

Referring now to the drawings in detail, FIG. 1 schematically illustrates a control system generally referred to by reference numeral 10 associated with a sheet material collator having a mechanical drive 12 through which cyclic movement is imparted to various components of the collator. The collated material is adapted to be enclosed in a flexible film envelope by means of a wrapper machine with which a drive 14 is associated. A continuous drive connection 16 between wrapper drive 14 and collator drive 12 maintains operational synchronism between the collator and the wrapper. A common source of power 18 has a start control switch 20 through which power is supplied to the wrapper drive 14. The foregoing arrangement is generally well known in the art as hereinbefore referred to.

The collator has associated therewith a gripper device 38 operated by an operating mechanism 22 during cyclic movement thereof by the collator drive 12 in accordance with the present invention. The operational phase relationship between gripper operation and its movement is determined by phase control 26 as will be explained in detail hereinafter.

Figure 2:
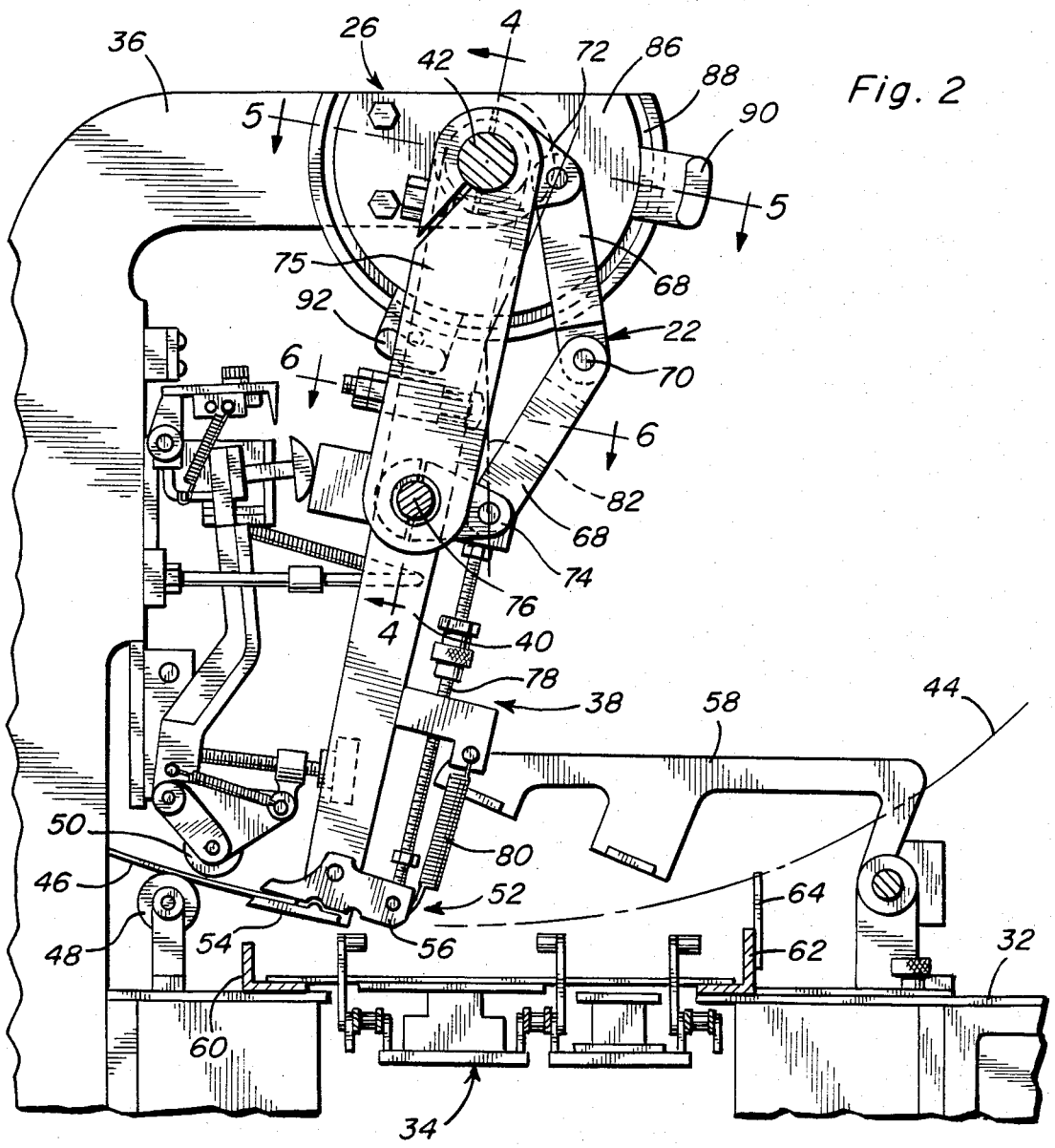
FIG. 2 is a partial end view of a collator at one of its collating stations.
Figure 3:
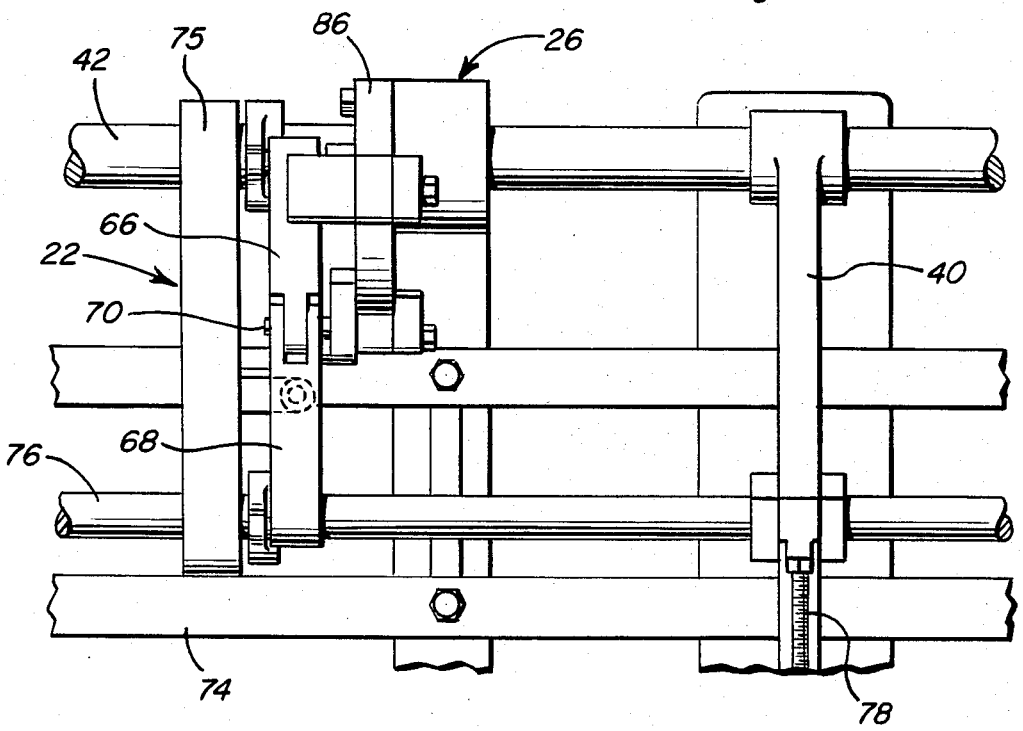
FIG. 3 is a partial side of the collator at the collating station as shown in FIG. 2.
Figure 4:
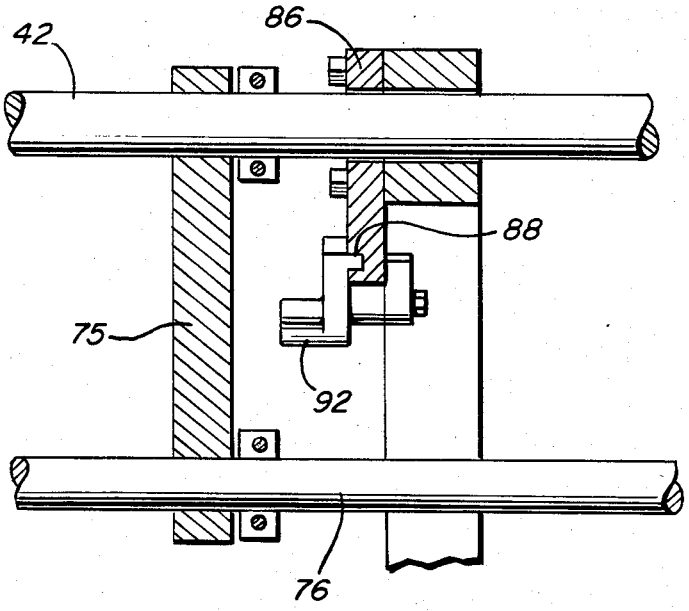
FIGS. 4, 5 and 6 are partial sectional views taken substantially through planes indicated by section lines 4—4, 5—5 and 6—6 in FIG. 2.
Figure 5:
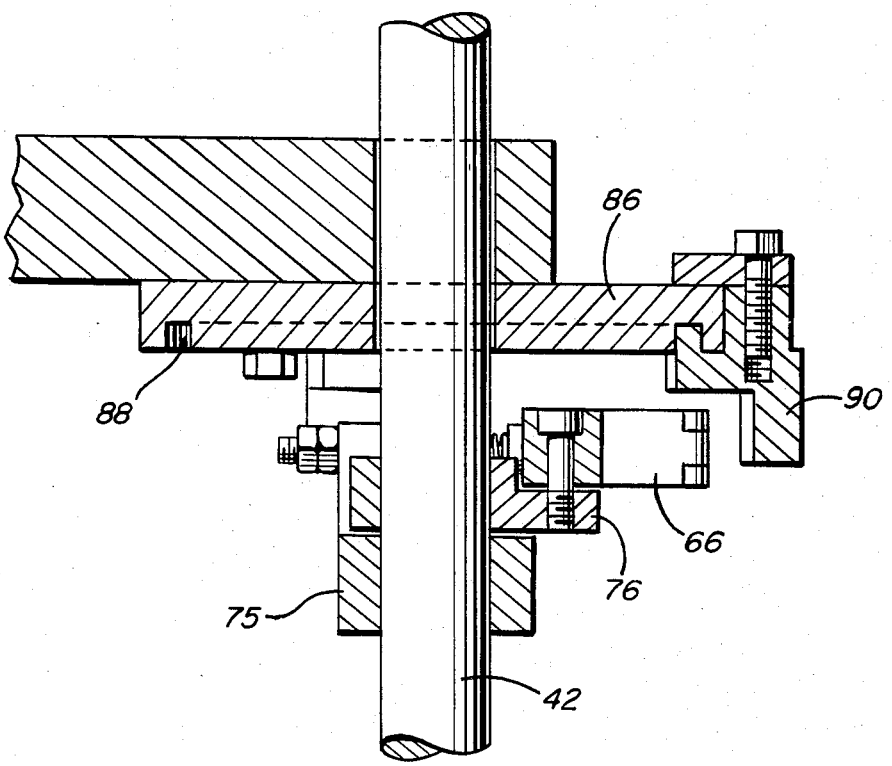

FIG. 2 illustrates a portion of the collator at one collating station. The collator frame supports a main bed 32 overlying a horizontal conveyor 34 through which collated material deposited onto bed 32 is transported to the envelope wrapper. A support portion 36 of the frame mounts one of the gripper devices 38 at each collating station. Each gripper device includes a gripper arm 40 fixed to a common power shaft 42 for oscillation of a jaw assembly 52 through a fixed stroke along a travel path 44 between limit positions. A sheet 46 withdrawn from a sheet material storage or magazine portion of the collator (not shown) is held between a fixedly mounted roller 48 and a movable roller 50 in alignment with travel path 44 of the jaw assembly. The jaw assembly includes a fixed jaw 54 secured t the lower end of the gripper arm 40 and a pivotally movable jaw 56. From a limit position opposite the limit position shown in FIG. 2, the gripper arm is displaced in one direction with its jaws 54 and 56 open. Upon reaching the limit position shown in FIG. 2, the jaws close and grip the sheet material 46. The movable roller 50 is then withdrawn from engagement with the sheet 46 so that subsequent movement of the gripper arm in the other direction will carry the sheet along path 44 over the conveyor 34. The jaws are timely opened to release the sheet during travel of the gripper arm for deposit of the sheet onto the conveyor between guide rails 60 and 62 fixed to bed 32. A stop element 64 prevents overtravel of the sheet after release, as the gripper arm approaches its limit position. A hold-down element 58 which was pivotally raised to the position shown in FIG. 2, is displaced downwardly as the gripper arm approaches the right-hand limit position. The hold-down element thereby holds the deposited sheet material on bed 32 for transport by the conveyor 34 from the collating station. The collator drive 12 referred to in connection with FIG. 1, effects cyclic movement of the gripper arm 40, the movable roller 50, hold-down element 58, conveyor 34 and other machine components not shown, in operational synchronism. The synchronizing drive arrangement for the foregoing components is already known and forms no part of the present invention. The synchronized operation of the gripper jaw assembly 52, however, is effected in accordance with the present invention.

Figure 6:
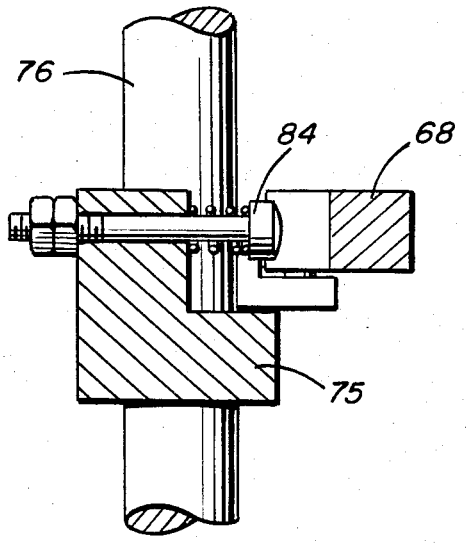

In accordance with the present invention, there is no direct mechanical drive connection from the collator drive to the jaw assembly 52. Instead, the jaw assembly is operated by the operating mechanism 22 in the form of a toggle linkage including toggle links 66 and 68 interconnected by a toggle pin 70. The remote ends of the toggle links are respectively pivotally connected to pivot arms 72 and 74. Pivot arm 72 is connected to a lever member 75, fixed to power shaft 42 while pivot arm 74 is fixed to an operating shaft 76 carried by the gripper arm 40 and the lever 75. The operating shaft 76 is connected by adjustable link 78 at the gripper arm to its movable jaw 56. Jaw 56 is biased to a closed position by spring 80. The spring 80 will therefore yieldably hold the toggle links 66 and 68 in one of two overcenter positions as shown in FIG. 2, corresponding to a closed position of the jaws. The toggle links are displaced overcenter toward the other open jaw position shown by dotted lines 82 to angularly displace the pivot arm 72 downwardly relative to the position shown in FIG. 2 for jaw opening purposes. The open jaw position of the toggle linkage is adjustably set by a stop element 84 as more clearly seen in FIG. 6. The stop element is adjustably mounted on the member 75 so as to limit overcenter movement of toggle link 68 and thereby hold pivot arm 74 in an angular position corresponding to the open position of movable jaw 56.

The phase control 26 is operative to actuate the toggle linkage for overcenter movement as aforementioned so as to open the jaws during travel of the gripper arm in a right-hand direction as viewed in FIG. 2. The jaws will then remain open until the toggel linkage is again actuated in the opposite direction when the gripper arm returns to the limit position shown in FIG. 2. Such opening and closing of the jaws will respectively release a sheet and grip another sheet, and such action occurs in proper phase relation to the oscillatory travel of the gripper arm.

The phase control 26 includes a frame fixed plate 86 axially positioned along power shaft 42 adjacent to the toggle linkage mechanism 22. An arcuate groove 88 is formed in the plate 86 having a center of curvature lying on the axis of the power shaft. Two toggle actuating trip elements 90 and 92 are slidably received in the groove 86 and locked in angularly adjusted positions on the plate 86 for engagement with the toggle link 66. Accordingly, angular travel of the gripper arm in a right-hand direction as viewed in FIG. 2, will bring toggle link 66 into engagement with actuator element 90 to displace the toggle linkage from its closed jaw position to its open jaw position. The element 90 may therefore be adjustably positioned to effect release of a sheet precisely at the desired phase location of the gripper arm during travel. The actuator grip element 92, on the other hand, may be adjustably positioned to cause timely closing of the jaws over a sheet 46 projecting from the rollers 48 and 50 as the gripper arm approaches the limit position shown in FIG. 2.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a cyclically displaceable gripper and mechanical drive means connected to the gripper for displacement thereof through a travel stroke of fixed amplitude, the improvement comprising mechanical linkage means connected to the gripper for cyclic operation thereof, and phase control means engageable with the linkage means for establishing a predetermined phase relationship between the cyclic operation of the gripper and the travel stroke, said phase control means including at least two trip elements engageable with said linkage means for imparting gripping and release movements thereto at selected phase locations during said displacement of the gripper.

2. In combination with a collator having a cyclically displaceable gripper and mechanical drive means connected to the gripper for displacement thereof through a travel stroke of fixed amplitude, the improvement comprising operating means connected to the gripper for cyclic operation thereof, and phase control means engageable with the operating means for establishing a predetermined phase relationship between the cyclic operation of the gripper and the travel stroke, said phase control means including at least two actuators and means engageable by said actuators for imparting gripping and release movements to the operating means at selected phase locations of the gripper during travel, said operating means comprising a toggle linkage.

3. The combination of claim 2 wherein said actuators comprise fixed toggle engaging trip elements.

4. The combination of claim 3 including stop means engageable with the toggle linkage for limiting movement thereof to an open jaw position.

5. In collator from which collated sheets are delivered, having a gripper arm displaceable through a stroke of fixed amplitude and jaw means on the gripper arm for gripping and releasing said sheets during travel of said gripper arm, the improvement comprising drive means for effecting said travel of the gripper arm, mechanical operating means connected to the gripper arm for closing and opening the jaw means to establish an operational phase of said stroke of the gripper arm and phase controlling trip means mechanically engageable with the jaw operating means for timely terminating said operational phase by opening of the jaw means.

6. The combination of claim 5 including a wrapper to which the collated sheets are delivered, and means connecting the drive means to the wrapper for operation thereof in synchronism with travel of the gripper arm.

7. In combination with a collator from which collated sheets are delivered, and a wrapper having means for drive thereof, said collator having a gripper arm displaceable through a stroke of fixed amplitude and jaw means on the gripper arm for gripping and releasing said sheets during travel of said gripper arm, the improvement comprising drive means connected to the wrapper for effecting said travel of the gripper arm in synchronism with the wrapper, jaw operating means connected to the gripper arm for closing and opening the jaw means to establish an operational phase of said stroke of the gripper arm and phase control means engageable with the jaw operating means for timely terminating said operational phase by opening of the jaw means, the jaw operating means comprising a toggle linkage operatively connected to the jaw means.

8. The improvement as defined in claim 7 including stop means for limiting movement of the toggle linkage to an open jaw position, said phase control means including actuator means for displacing the toggle linkage between said open jaw position and a closed jaw position in response to travel of the gripper arm.

9. The improvement as defined in claim 8 wherein said actuator means comprises at least two adjustably fixed trip elements engageable with the toggle linkage.

10. In combination with a collator from which collated sheets are delivered, said collator having a gripper arm displaceable through a stroke of fixed amplitude and jaw means on the gripper arm for gripping and releasing said sheets during travel of said gripper arm, the improvement comprising drive means connected to the gripper arm for drive thereof, mechanical linkage operating means mounted on the gripper arm for closing and opening the jaw means to establish an operational phase of said stroke of the gripper arm, phase controlling trip means mechanically engageable with the operating means for timely terminating said operational phase by opening of the jaw means and stop means engageable with the operating means for limiting said opening of the jaw means.

11. In combination with a collator from which collated sheets are delivered, said collator having a gripper arm displaceable through a stroke of fixed amplitude and jaw means on the gripper arm for gripping and releasing said sheets during travel of said stripper arm, the improvement comprising drive means connected to the gripper arm for drive thereof, jaw operating means mounted on the gripper arm for closing and opening the jaw means to establish an operational phase of said stroke of the gripper arm, phase control means engageable with the jaw operating means for timely terminating said operational phase by opening of the jaw means and stop means engageable with the operating means for limiting said opening of the jaw means, the jaw operating means comprising a toggle linkage operatively connected to the jaw means.

12. The improvement as defined in claim 11 wherein the phase control means includes fixed trip means engageable with the toggle linkage for displacement thereof between jaw opening and closing positions in response to travel of the gripper arm through said stroke thereof.

* * * * *